US005543806A

United States Patent [19]

Wilkinson

[11] Patent Number: 5,543,806

[45] Date of Patent: Aug. 6, 1996

[54] ADAPTIVE ANTENNA ARRAYS FOR HF RADIO BEAMFORMING COMMUNICATIONS

[75] Inventor: Robert Wilkinson, Portsmouth, England

[73] Assignee: The Secretary of State for Defence in Her Britannic Majesty's Government of the United Kingdom of Great Britain and Northern Ireland, London, England

[21] Appl. No.: 451,718

[22] Filed: Nov. 30, 1989

[30] Foreign Application Priority Data

Dec. 5, 1988 [GB] United Kingdom ..... 8828306

[51] Int. Cl.[6] ..... H01Q 3/22

[52] U.S. Cl. ..... 342/368; 342/383

[58] Field of Search ..... 342/368, 371, 342/372, 383, 384

[56] References Cited

U.S. PATENT DOCUMENTS 4,189,733 2/1980 Malm .

4,217,587 8/1980 Jacomini .

4,720,712 1/1988 Brookner et al. .

*Primary Examiner*—Mark Hellner

*Attorney, Agent, or Firm*—Nixon & Vanderhye P.C.

[57] ABSTRACT

HF aerials for ship-shore communications consist of spaced dipole arrays. By appropriate adaptive phasing very high gain HF aerials are formed. On transmission a feedback signal is required from the receiver, otherwise similar algorithms are used to control the beamforming. A random phase algorithm has been devised for the phases applied to the array aerials, operating in four tranches of 100 iteration steps with progressively reduced maximum phase variation. The initial step has a phase variation in the range ±180°. The algorithm has the advantage that there is a high probability that a relatively high gain beam will be immediately formed in the required direction and thus the system can quickly settle towards a direction where the signal is weak. When in the transmit mode the receiver returns a signal to the transmitter giving the step number of the random phases which gives the maximum received signal.

24 Claims, 10 Drawing Sheets

212
24
25
213
22
23
BEAM CONTROL ALGORITHM
SIGNAL DISCRIMINANT
26
ARRAY DRIVER 21
CODING
27
20
28
29
DECODING
211
210

ITERATIVE PHASE ADJUST
41
42
D
43
44
45

Ae 1
Ae2
Ae 3
Aen
D
51 1
51 2
51 3
51 n
53
54
O/P
CONTROL ALGOR'M 55
RANDOM PHASE ADJUSTMENT ALGORITHM 52

START
REPEAT 100 TIMES
72
RANDOM ANTENNA PHASE +/-180°
70
1st Loop
71
SELECT PHASE FOR MAXIMUM OUTPUT
73
REPEAT 100 TIMES
75
ALTER SELECT PHASE +/-90°
76
2nd Loop
74
SELECT PHASE FOR MAXIMUM OUTPUT
77
REPEAT 100 TIMES
79
ALTER SELECT PHASE +/-60°
710
3rd Loop
78
SELECT PHASE FOR MAXIMUM OUTPUT
711
REPEAT 100 TIMES
713
ALTER SELECT PHASE +/-40°
714
4th Loop
712
SELECT PHASE FOR MAXIMUM OUTPUT
715
BEAM FORM
716
717
O/P PREDICTED POLAR RESPONSE (SUB'OPT)
84
ARRAY MODEL
85
22
10dB
20dB
211
212
BEAM FORMING
21
20
STOCHASTIC PHASE ALGORITHM
81
DECODING
210
RX
89
29
80
TX
28
27
CONTROL
82
83
88
86
87
RX
24

DATA MESSAGE
93
4th Iteration loop
TRAINING SIGNAL (+/-40°)
92
3rd Iteration loop
TRAINING SIGNAL (+/-60°)
91
2nd Iteration loop
TRAINING SIGNAL (+/-90°)
90
1st Iteration loop
FIXED TRAINING TRANSM'N (+/-180°)
Td
Tr
94
Random delay
1 OF 100 (N) Coded signal
1 sec
1
2
3
4
5
99
100
Tp
95
83
(=>10 mS)

PREDICTED POLAR RESPONSE (SUB'OPT)
84
22
212
10dB
20dB
24
RX
87
86
COMPUTER MODEL
85
TX BEAM FORM
21
106
LINK CONTROL
82
20dB
10dB
80
TX
101
TX BEAM CONTROL
109
28
27
88
104
RX BEAM FORM
COMPUTER MODEL
102
103
BEAM FORM ALGORITHM
PREDICTED POLAR RESPONSE (SUB'OPT)
108
107
105

ADAPTIVE ANTENNA ARRAYS FOR HF RADIO BEAMFORMING COMMUNICATIONS

The invention relates to antennas for HF radio transmission and reception and in particular to adaptive antenna arrays.

It is generally accepted that there are advantages in using greater transmitter power for HF radio communications since it will normally improve the quality, performance, availability and the range of a particular link. These improvements can be achieved because the received signal will be less susceptible to interference and some of the normal fading characteristics associated with radio propagation. These advantages may, however, not always be worthwhile, particularly on ships and aircraft, because co-site interference and inter-modulation products (rusty bolt) can drastically reduce the overall communications effectiveness of the platform by prohibiting simultaneous reception of incoming signals on other radio frequencies over a much greater bandwidth.

Additionally, and perhaps sometimes more importantly, any increase in transmitter power of the platform's emissions will increase the vulnerability to interception and location, and thereby increase the threat of electronic counter-measures. Increasing the transmitter power in order to improve communications may therefore not be beneficial from the wider viewpoint although it is accepted it may be the only option on particular occasions. Normally, therefore, it is more advantageous to use a signal with a waveform which has some degree of inherent protection against interference and propagation anomolies etc. This could include Error Detection and Correction (EDAC), frequency diversity and adequate frequency management (either automatic or manual).

An example of a communications system using beth frequency and time diversity is described in GB Patent No 2092415. Frequency management to mitigate the effects of channel interference can be achieved by using ionospheric sounders to measure the characteristics of the transmission path as described in GB Patent Application No 0525105 or by means of suitable noise sampling of communications channels in a frequency diversity system coupled with a suitable algorithm for combining redundant low noise channels as is described in the above mentioned GB Patent No 2092415. Using these and other signal processing techniques it is possible to improve the performance of most communications links without using larger transmitter powers although all of them may reduce the through-put rate of the channel and increase the complexity and cost of the radio systems.

An alternative method for improving communications, which has none of these disadvantages, is to use high gain directional antennas since the Effective Radiated Power (ERP) can be significantly greater than the mean transmitter power being emitted. Under these circumstances the co-site interference problem can be the same or less than before but the power of the transmitted signal can be much greater. For ship to shore communications, for example, the shore transmitter power need only be 100 W to send a signal of greater than 10 Kw to a ship at sea, if the directional gain of the shore antennas is >20 dB. Similarly, transmission signals from ships can be enhanced by using directional receiving antennas at the shore receive site, to improve the quality of the ship to shore link.

In both cases the improvement is achieved by 'focusing' the antenna gains in a specific direction and elevation. In general, the radiated beamwidth will become much more narrow, (in direction and elevation), as the gain and frequency are increased.

There would therefore also be considerable operational advantages if ships could also generate these high gain directional beams because the threat by jamming and interception could be considerably reduced for both ship/ship and ship/shore communications. At present the only method available to produce a direction beam of modest gain at HF is to use a log periodic antenna or something similar. This type of antenna is already being widely used on shore based stations because they are a cost effective solution for improving communications. Unfortunately these antennas are very large structures at HF frequencies and cannot be moved to change the transmission (or reception) direction. To overcome this problem three or more antennas are normally used to provide complete 360° directional coverage, albeit at reduced gain at some specific directions because of gaps in the overlapping coverage. Another limitation with this type of antenna is the inability to vary the elevation angle of the beam because this, as well as direction, is wholly dependent on the physical characteristics of the antenna. Moreover the maximum gain will also vary (as will its elevation angle) with the signal frequency. These factors will drastically reduce the effective gain of the antenna at the required signal elevation and direction. In addition, these antennas can only be erected on land using a large clear site and a good ground plane, because local obstructions or superstructures will deflect the beam and reduce the ERP gain.

The object of the present invention is to provide a transmitter and/or receiver in a high frequency communications system with a capability of producing a high gain directional beam or polar response curve for transmission and/or reception when coupled to an antenna array.

The invention provides in one form a communications equipment including an adaptive transmitter beamforming equipment for connection to an array of antennas in a high frequency communications system comprising:

a) a high frequency transmitter having an input for receiving a test signal to be transmitted and an output arrangement for providing a plurality of identical signals for transmission;

b) means to independently adjust the phase of each output signal;

c) means for connecting the phase-adjusted signals to respective antennas in the array;

d) means to initialise the phases to zero;

e) means to randomly set the phase of each output signal within predetermined limits of the initialised phases;

f) means to repeat step d) a number (N) of times;

g) remote receiver means to determine which one of the random phase sets (N) produces the maximum received signal and to produce a coded signal representative of that one number;

h) means to transmit the coded signal to the high frequency transmitter;

i) means to decode the number signal and to initialise the phases to the phase set producing the maximum signal at the remote receiver;

j) means to set a lower predetermined limit for the phase adjustments; and k) means to repeat steps e) to j) to successively improve the focus of the transmitter beam towards the receiver.

The invention provides in a further form an adaptive receiver beamforming equipment for connection to an array of antennas in a high frequency communications system comprising:

a) a high frequency receiver having a plurality of inputs for receiving signals produced by respective antennas in the array in response to a remote transmission;

b) means to independently adjust the phase of each antenna signal;

c) means for connecting the phase-adjusted signals to the receiver;

d) means to initialise the phases to zero;

e) means to randomly set the phase of each output signal within predetermined limits of the initialised phases;

f) means to repeat step d) a number (N) of times;

g) means to determine which one of the random phase sets (N) produces the maximum received signal;

h) means to initialise the phases to the phase set producing the maximum received signal;

i) means to set a lower predetermined limit for the phase adjustments; and j) means to repeat steps e) to i) to successively focus the receiver beam towards the transmitter.

Preferably the arrays for transmission and/or reception are formed from a plurality of wideband dipoles or monopoles.

In preferred arrangements the number of steps (N) in each iteration phase is 100 and the limits for the phase adjustments in the iteration phases are successively set at ±180°; ±90°; ±60° and ±40°.

Advantageously a communications system will include an adaptive antenna array for both transmission and reception. The arrangement may be such that the random phase beamformer is used for one mode, transmission or reception, and a decision tree beamformer is used for the second mode.

When used for adaptive array transmission the remote receiver includes:

a signal discriminator selectively responsive to the transmitter test signals and the remote receiver transmits the coded number signal, representing the transmitter step producing the maximum received signal, a discrete time after receiving the first stage of N test transmissions. In one arrangement the discrete time for the coded response may be pseudo-randomly selected after each stage.

In one arrangement a transmitter/receiver is provided with adaptive beamforming for reception and transmission, the arrangement being such that separate beamforming algorithms are provided for transmission and reception. Once the transmission or reception beam is formed there may be provided means to generate a predicted polar beam response from stored data on the array, the predicted polar response serving to provide a direction finding capability. When adaptive beamforming is used for reception and transmission the polar response may be produced from both the transmission beamformer and the reception beamformer.

There may be provided means to automatically limit the transmitted power radiated in the direction of the beam so as to minimise possible co-site interference and the likelihood of unwanted interception.

In an advantageous arrangement where information on the direction of the receiver or the transmitter is known the communications equipment may be provided with beamforming means combining calibrated array and random phase adaptive principles to produce a first calibrated array in the desired or known direction and then to apply limited random phase iterations to optimise the beam direction.

The invention will now be described by way of example only with reference to the accompanying Drawings of which:

Figure 1:
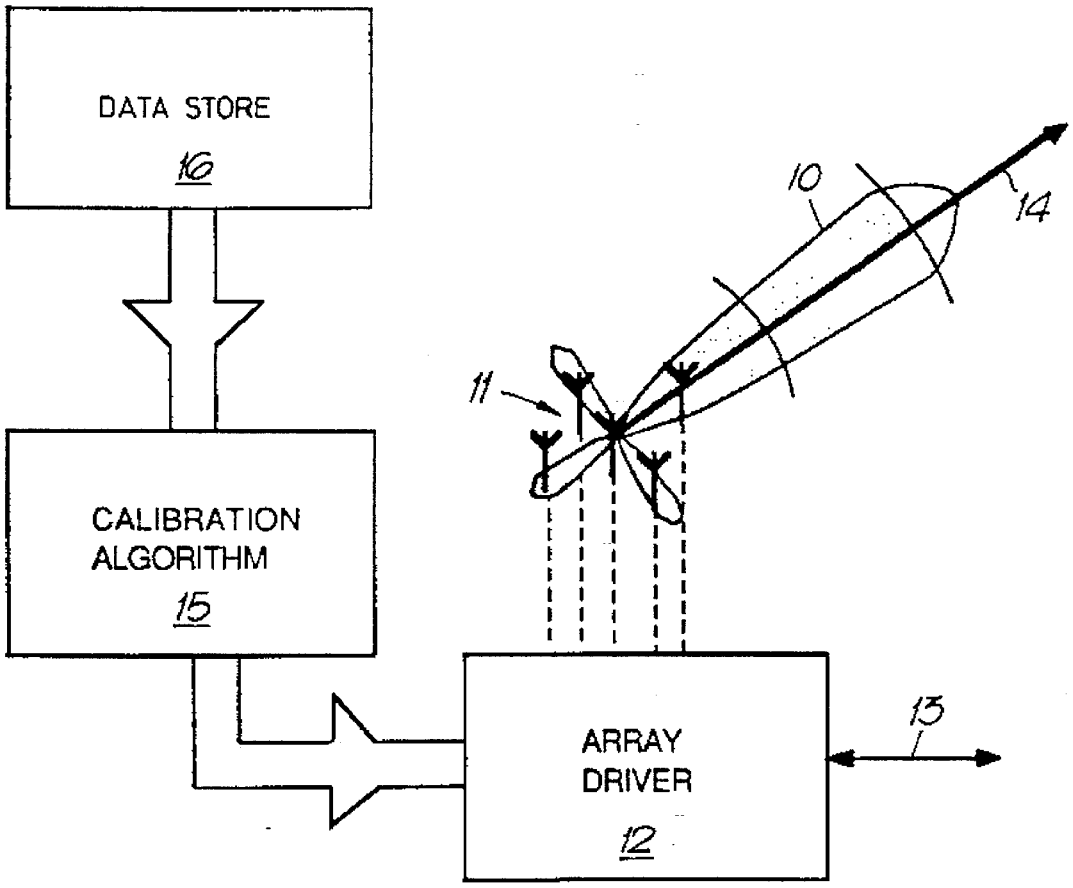
FIG. 1 is a schematic block diagram of a conventional calibrated antenna array for radio transmission or reception.

FIG. 1 illustrates a conventional calibrated array for transmission or reception using a beamforming technique to provide a directed radiation pattern 10 towards a remote receiver or transmitter respectively. As shown an array of five spaced antennas 11 are connected to an array driver circuit 12 which provides appropriate phase delays to signals 13 to or from each antenna 11 in the array such that the beam pattern 10 may be formed in any required direction and elevation 14. The array driver 12 adjusts the phase of each antenna signal in response to a calibration algorithm in an array driver controller 15. The algorithm determines the phases for each antenna signal making use of information from a data store 16 on the antenna positions, the frequency, and the required beam direction and elevation. This is done by computing the geometric distances for each array element in the direction of the desired beam. With this type of arrangement difficulties arise because of the following factors:

a) positional inaccuracies of antennas;

b) local obstructions modifying the radiation beam pattern;

c) phase inaccuracies in the array driver and antennas; and d) need to know the beam direction accurately.

In an alternative adaptive receiving arrangement the control algorithm adjusts the phase of the signals from each antenna until a maximum received signal is detected. This arrangement does not suffer from the above-mentioned limitations of the calibrated array. There is, however, a need to distinguish the wanted signal from unwanted interference and thus the system can only be used on signals with known waveform characteristics.

Figure 2:
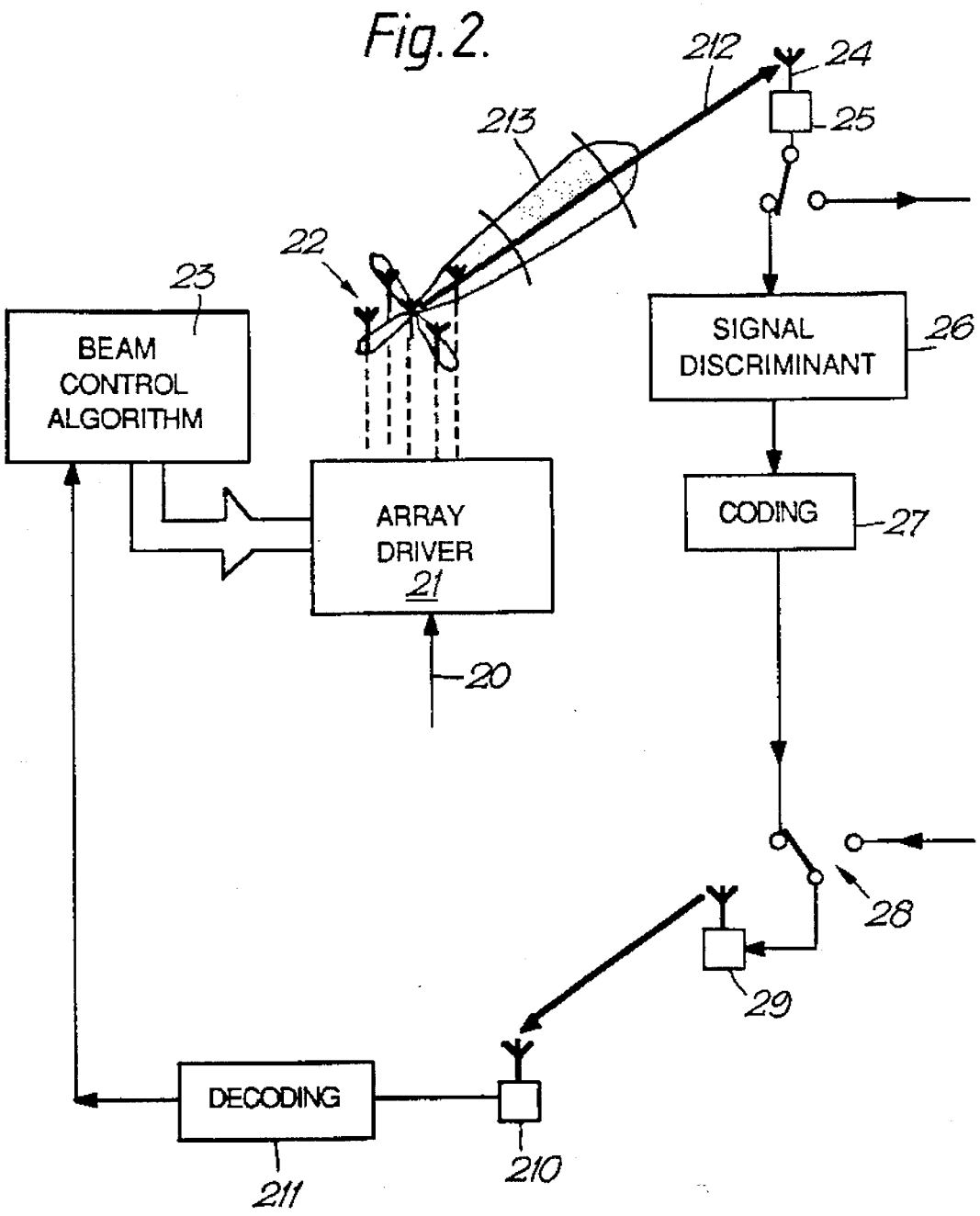
FIG. 2 is a schematic block diagram of an adaptive transmitter array system.

FIG. 2 illustrates operation of an adaptive transmitting array. The signal to be transmitted is connected to the input 20 of an array driver 21 for an antenna array 22. The phases of the transmitted signals to each antenna in the array 22 are adjusted by the array driver 21 under control of a beam control algorithm 23. Signals received by a remote station are connected from a receiver aerial 24 via a receiver 25 to a signal discriminating circuit 26 which is responsive to predetermined transmitted signals. The output from the signal discriminator 26 is coded (27) then connected by a switch 28 to the transmitter via a control radio link connecting a radio transmitter 29 at the remote station to a local receiver 210. The received signal from the local receiver 210 is decoded (211) to provide an output signal for controlling the transmitter beamforming algorithm to optimise the direction 212 of the beam 213 towards the remote receiving station. Conventionally, a very large number of iterative control feedback steps are required.

Figure 3:
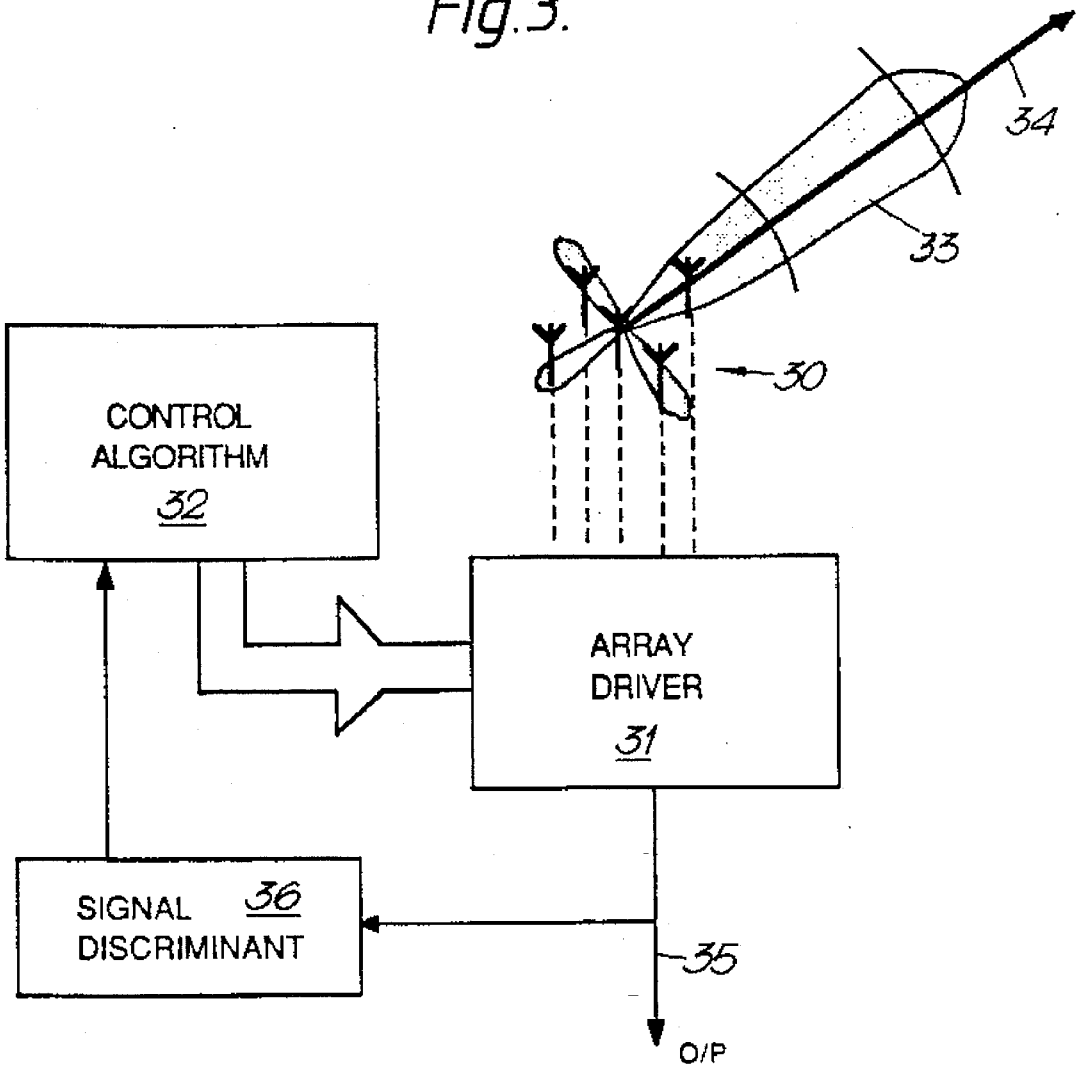
FIG. 3 is a schematic block diagram of an adaptive receiver array system.

An adaptive receiving array system shown in FIG. 3 operates in similar fashion to the FIG. 2 transmitter. Signals from the receiver antennas 30 have their phases adjusted by the array driver 31 under control of a control algorithm 32 such that the reception beam 33 is formed in the direction 34 of an incident signal. A control feedback link connects a signal output 35 from the array driver 31 via a signal discriminator 36 to the control algorithm circuit 32. The signal discriminator 36 filters out unwanted interference being received and the control feedback link to the control algorithm adjusts the phase of the signals from each antenna until a maximum wanted received signal is detected.

The adaptive array systems for transmission and reception rely upon effective signal discrimination and an efficient control algorithm to direct the array beam for maximum signal transmission/reception. The antennas of the arrays ideally should each have a uniform polar radiation pattern (isotropic) such that identical beams can be formed in any direction or elevation by suitable adjustment of signal phases from the antennas. In practice true omni-directional cover cannot be realised. However at HF complete omni-directional cover is not normally required for long wave and groundwave communications. Dipoles and (mainly) monopoles are therefore used as the principal HF antennas. For the present invention short active dipole antennas are used. In an adaptive array each antenna (normally) receives the same signal although with a slightly different relative phase. The phase correction applied to each element is designed only to produce a maximum gain at the output for the desired signal. Other signals arriving from all other directions will have a different phase characteristic so these will not add coherently and produce a maximum output. If the number of other noise signals is large and the phase of each is random then the output noise power gain (Pn) of the array will be 10 log(n) dBs, where n is the number of antenna elements.

The wanted signals from each antenna are designed to add coherently to produce a maximum output level. The signal gain produced by the array is therefore 20 log(n) dBs.

The signal to noise ratio (Ps/Pn) gain from an array (relative to one antenna) will therefore be 10 log(n) provided the number of interferers is large and that they arrive from many directions.

In a transmitting array the phase of each antenna signal will be adjusted, in a similar way as receive, to produce a signal which adds coherently in the desired direction. The effective radiated power (ERP) gain of a transmitting array will therefore also be 20 log(n) dBs. For a 16 element array the ERP will be 20 log(16), i.e. 24 dB (or 256 times the power). To form a beam of 10 kW each antenna power amplifier need therefore only provide 40 W of antenna drive.

In the receive array each antenna is connected to a 'radio receiver' to convert the signal frequency to a common Intermediate Frequency (IF). After conversion the signal is phase adjusted at the IF before being 'summed' together with all the other antenna signals. The combined output is then used by the beamforming algorithm (after signal discrimination) to control the phase adjustment to each antenna signal.

For multiple element receive arrays it can be shown that the beam gain relative to a single antenna can be 20 log(n) where n is the number of antenna elements. It can also be shown that the total noise or interference power received will be 10 log(n) provided there is large number of noise sources coming from all directions. The signal to noise ratio of the received signal from the adaptive array will on average therefore be 20 log(n)−10 log(n)=10 log(n). This improvement in signal to noise ratio is what could be achieved in omni-directional uniform noise. In practice this figure could be as high as the beam gain (20 log(n)) but this will depend on the precise direction of the interference and the polar radiation pattern produced by the array.

As a transmitting system this array will deliver the maximum ERP in the wanted direction with a beamwidth of less than 10° (3 dB).

The controlling algorithm used in the Adaptive Receiving Array system shown in FIG. 3 is required to create an optimum beam, having a gain of 20 log(n) (where n is the number of array elements) in the correct direction and elevation of the wanted signal given only the waveform characteristics of the signal. This waveform characteristic will be 'embedded' in the Signal Discriminator. This discriminator therefore performs a very important function in the beamforming process because if other unwanted interference signals are accepted by the discriminator the beamforming algorithm will either become 'confused' and try to form two or more beams in different directions, or it will form a beam on an unwanted signal (interferer or jammer) in an incorrect direction.

Given an adequate signal discriminant, the adaptive receiving system must adjust the phase in each antenna receiving circuit to obtain the maximum wanted signal output level from the summing network. This can be achieved using simple signal feedback techniques. This control feedback can be used by the adaptive algorithm to select the best phase adjustment for each antenna element to give a greater summed output after making controlled phase iterations by monitoring the affects produced on the signal output level.

A decision tree algorithm to create an optimum beam can use parallel processing to create the final beam with a gain of 20 log(n), where n is the number of antennas, after log 2(n) iteration and can continually adapt to changes in the signal caused by movements in the array or position of transmitter etc.

Figure 4:
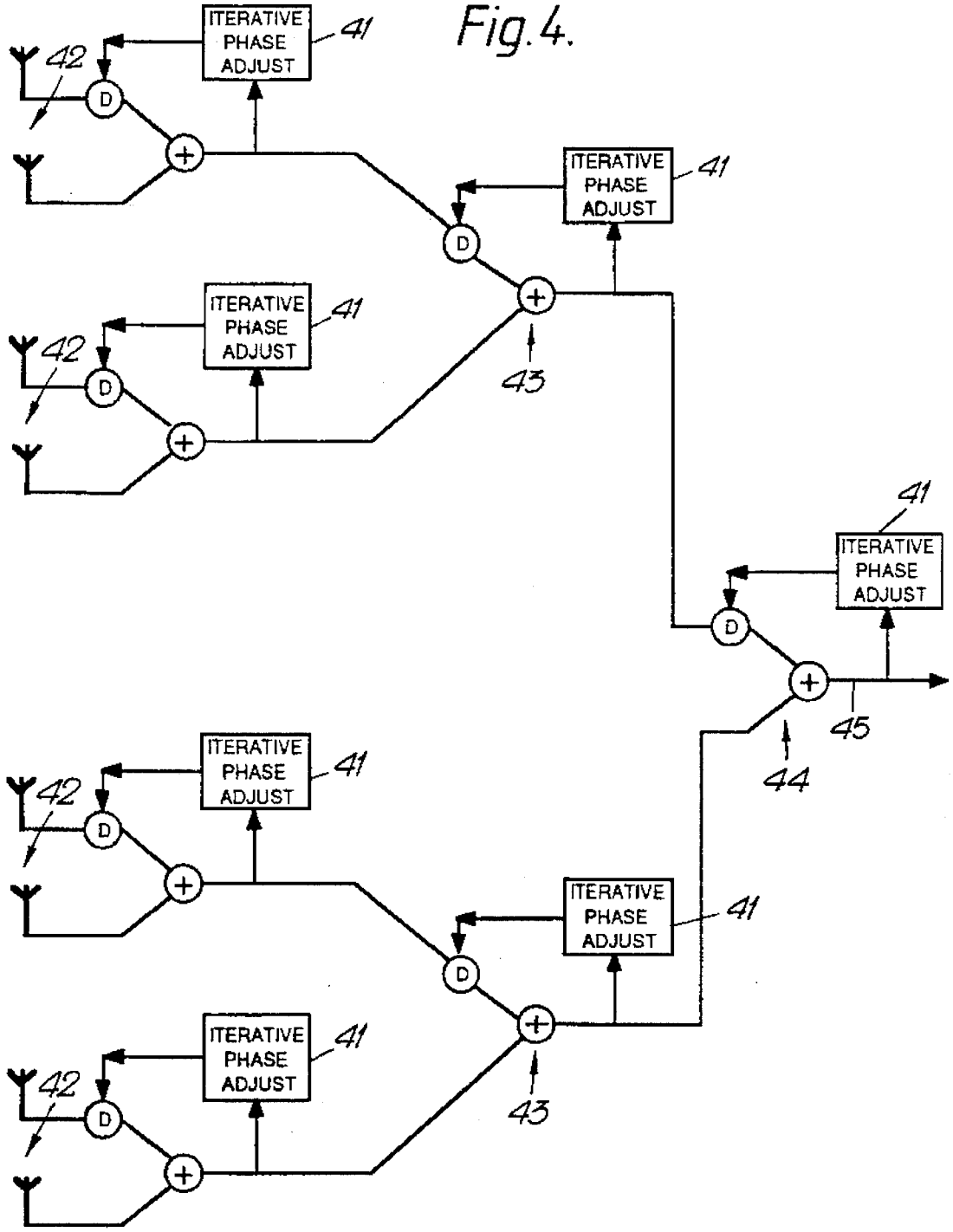
FIG. 4 shows a tree receiving system for beamforming in an adaptive array.

In this system the array elements are grouped into pairs, so the first (n/2) phase iterations can be done in parallel, using all array antennas (n). The phase adjustment mechanism is shown in FIG. 4 as the iterative phase adjustment algorithm 41 (including signal discrimination) coupling antenna pairs 42. The outputs from these antenna pair groups are then combined in a similar (43) way to produce a single output signal 44 with an enhanced quality and level.

The main advantage of this system is speed of convergence and an ability to provide continuous adaption using a simple algorithm. Also, the output from the system is always produced using all the antennas so the output level will nearly always be greater than from any one antenna (i.e. >0 dB) even before phase adaption has started. For example, the level will be 11 dB for 50 percent or >6 dB for 80 percent of the time.

Figure 5:
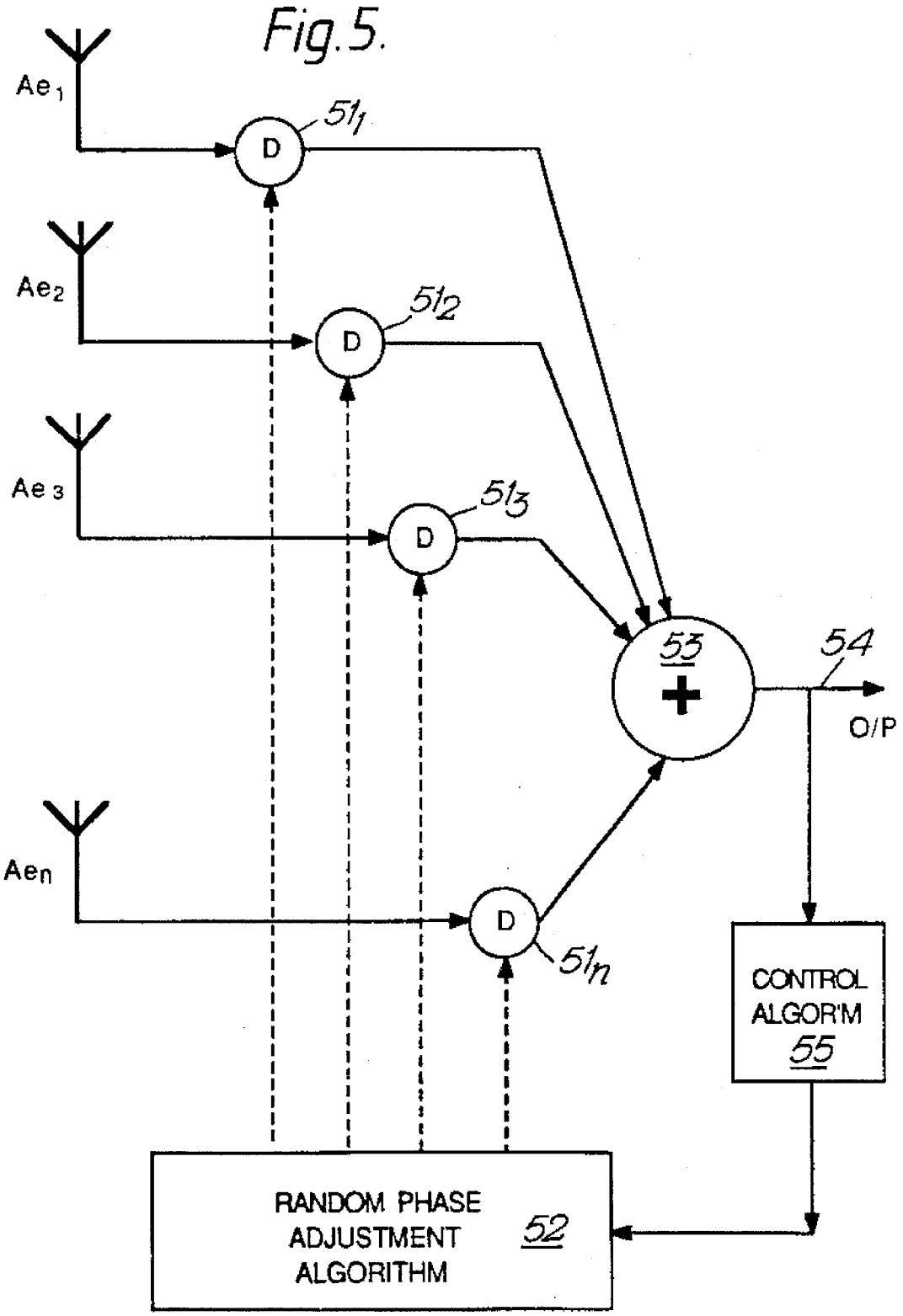
FIG. 5 shows a receiver antenna array system according to the present invention.

FIG. 5 shows a receiver beamforming system which uses a random phase algorithm. Signals from antennas $Ae_1$, $Ae_2$ . . . $Ae_n$ are phase adjusted via Drivers $\mathbf{51}_1$ . . . $\mathbf{51}_n$ by a random phase adjustment algorithm 52 as well be described below. The phase-adjusted signals are then summed (53) and the sum output 54 is fed back to the adjustment algorithm by a controller 55. In this arrangement the phase adjustment (D) at each antenna $Ae_n$) is randomly chosen and the output level (after signal discrimination) is measured. This is repeated many times (say 100) before the phase of each array element is chosen which produces the highest signal output level.

Figure 6:
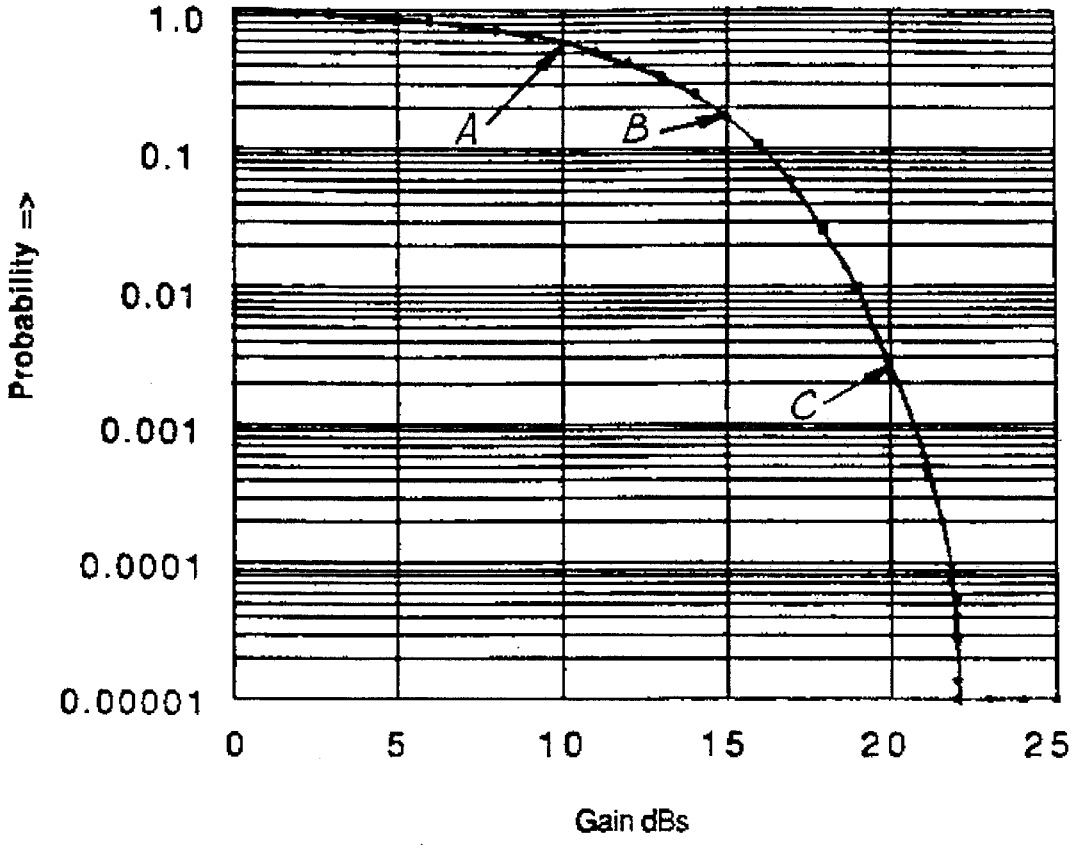
FIG. 6 is a theoretical graph showing the probability of randomly forming a beam of specified gain with the FIG. 5 arrangement.

The principles of operation for this technique are based on the probabilities of randomly forming a beam of a specified gain in any given direction, (for any frequency or array configuration). This probability, given in FIG. 6, is shown as the cumulative probability density function (PDF) of beam gain for a given random phase change at each antenna. For example, a beam gain of 10 dB or more can be achieved for nearly 60 percent of occasions (Point A), but a gain of 15 dB can only be achieved for 20 percent of the time (Point B).

Given these probabilities for a single event it is possible to calculate the probability of achieving a very high gain (say >20 dB) after many such attempts. This can be determined using the binomial theorem. For example, from FIG. 6 it can be shown that the probability of randomly obtaining a beam gain of >=20 dB with one attempt is about 0.002 (Point C). From the binomial theorem it can be determined that after 1000 attempts there is a 90 percent chance of getting one or more events where the gain will be >=20 dB. If the number of attempts is reduced, to say 100, this probability falls from 90 percent to 20 percent.

Further analysis has shown that this particular random phase algorithm will not always be able to produce a beam of acceptable gain, even when a 1000 attempt algorithm is used because the gain will always be between about 18.5 dB and 21.5 dB.

Figure 7:
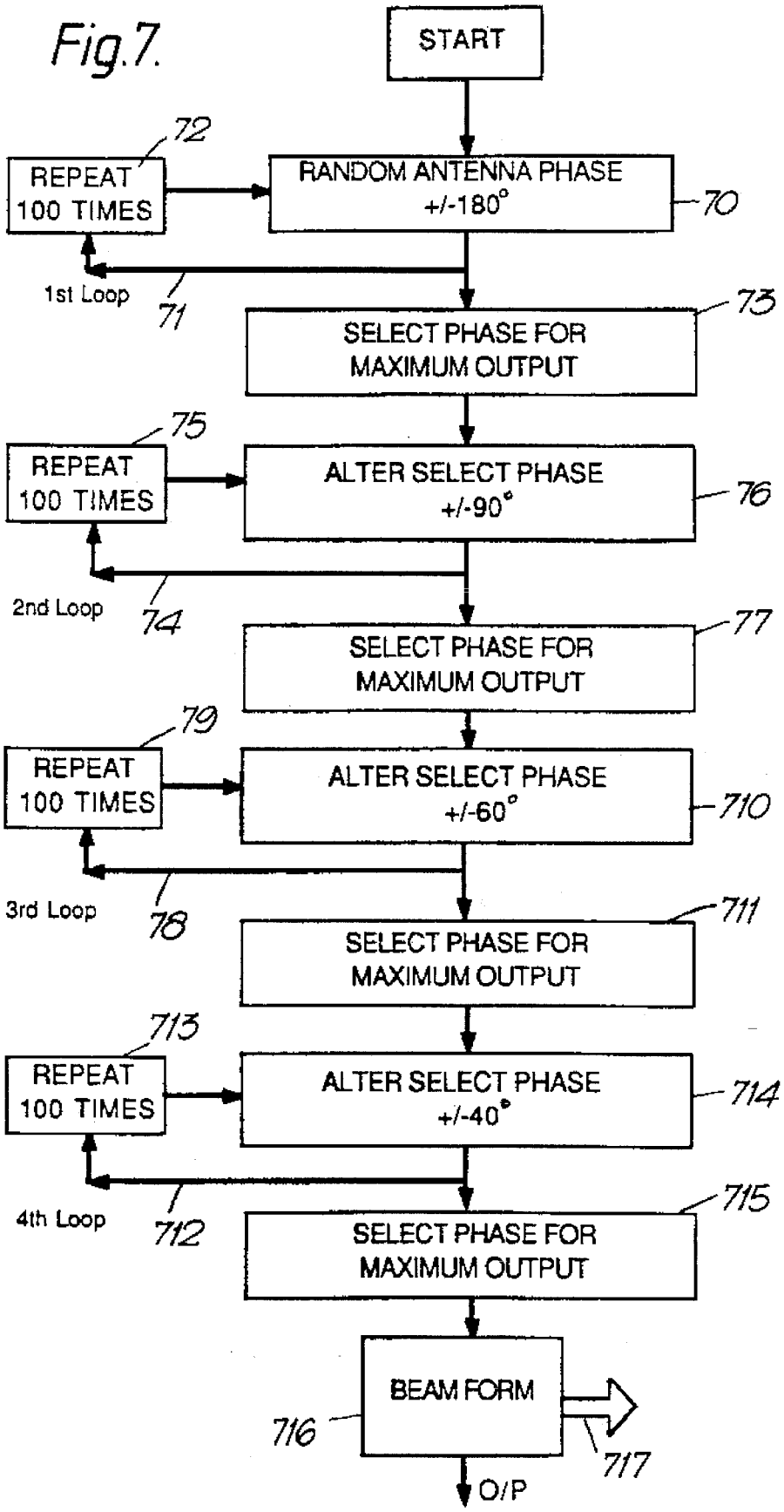
FIG. 7 shows a random phase algorithm adopted in the FIG. 5 receiver.

To overcome this limitation a modified random, phase algorithm has been devised, and this is shown in FIG. 7. In this algorithm the highest beam gain obtained by the first 100 (say) random phases in a first iteration loop, is 'fine tuned' by 3 more iteration loops, (each with a successively smaller random phase variation) to maximise the gain. The optimum number of phase iterations for each loop has been found to be about 100, and the best phase variations for each loop are ±180°, ±90°, ±60° and ±40°. These figures yield the best beam gain for the smallest total number of loop iterations.

As can be seen in FIG. 7 the random phase algorithm starts with antenna phase within the range ±180°(70). In a first loop 71 the phase is adjusted one hundred times (72) and the output is monitored during the hundred iterations. The phase corresponding to the maximum signal output is then selected (73). In a second loop 74 the selected phase is randomly altered one hundred times (75) within the limits ±90°(76). In a similar manner the phase corresponding to the maximum output signal in the second loop is selected (77). Third and fourth iteration loops (78–711, 712–715) randomly alter the respective selected phases by ±60° and ±40°. The final selected phase (715) is used to form the beam (716) and can be used (717) to provide a prediction of the polar response of the array. The improvement achieved after each loop can be seen from the following figures which give the range of gain achieved after each iteration loop:

| Loop No | Gain (dB) |
|---|---|
| 1 | 16–22 |
| 2 | 18.5–23 |
| 3 | 20–23.5 |
| 4 | 21–23.7 |

After four loops of the algorithm the polar radiation pattern of a 16 antenna array was shown to be almost identical to the optimum. Alteration of the total number of iteration steps from 400 to 200 showed a drop in minimum gain achieved of about 2 dB while doubling the number of iterations to 800 produced an increase in gain of about 1 dB. Since the algorithm convergence time is proportional to the number of steps, 400 is considered optimal. This algorithm has a considerable advantage over a decision tree algorithm when operating with very weak signals in a background of high interference. This occurs because a beam of quite high gain (between 16 dB and 22 dB) will always be generated by the first iteration loop (±180°) irrespective of the signal direction or quality. The signal discriminant, which selects the best iteration output during each algorithm loop, will therefore be operating with a signal of enhanced signal to noise level and so performance of the system under all conditions will be nearly optimal. With the decision tree algorithm the signal discriminator works initially with only two antenna inputs, giving a maximum gain of only 6 dB and very little improvement in quality because the beam it produces is so poor.

Figure 8:
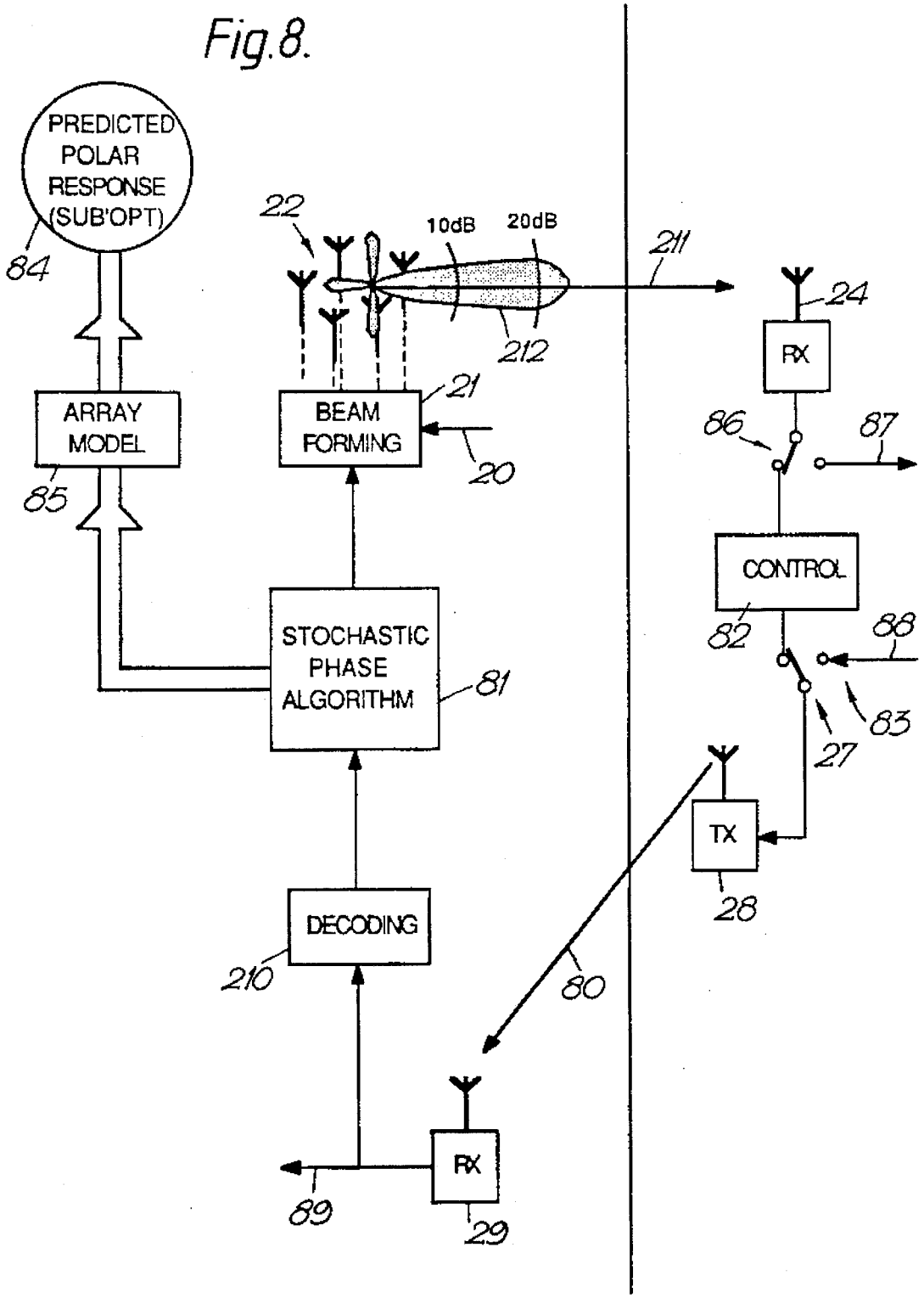
FIG. 8 shows a transmit beamforming system employing a random phase beamforming algorithm.
Figure 9:
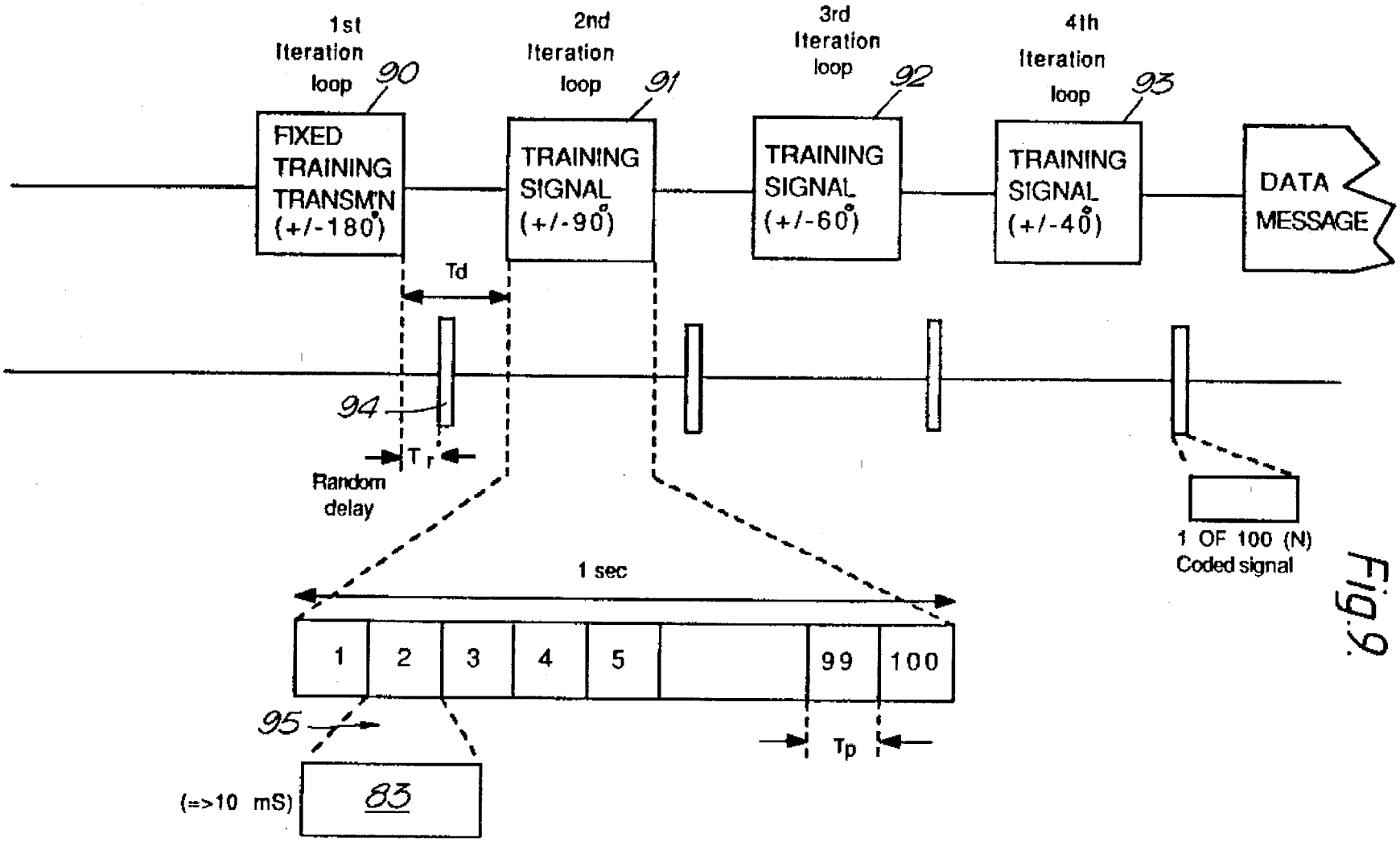
FIG. 9 is a timing diagram for the FIG. 8 system.

FIG. 8 shows how a transmitting beamforming system can be arranged using the random phase algorithm as could be applied to ship/shore communications. Integers similar to those shown in FIG. 2 are represented by like reference numerals. A shore antenna array 22 is shown transmitting to a ship-board receiving antenna 24. The requirement is for the shore transmitter to form the optimal gain beam in the correct direction (and elevation) of the receiving ship. If the shore transmitter array is a 'calibrated' system the beam (of suboptimal gain) can be directed (by the operator) at the ship if the exact direction and elevation are known. With a random phase control algorithm this is not required because the beam is automatically formed, irrespective of the direction and range of the ship. However, to form this beam it is necessary to have a beam control feedback link 80 from the ship to the transmit control algorithm 81 as shown in FIG. 8. To form the beam the transmitting system must follow the Random Phase Algorithm shown in FIG. 7 and the ship must respond (via the feedback control link) by selecting the phase iteration, in each loop, which gives the highest receiving signal. This routine is shown in more detail in FIG. 9.

During the first iteration loop 90 the beamforming algorithm must vary the phase of the transmitted signals in every array element within the range ±180° (i.e. totally randomly) for each of the hundred steps. The initial loop can therefore be used as a broadcast to all receiving stations because the beam gain performance (i.e. 16 to 22 dB) is achieved irrespective of frequency, direction, elevation or array configuration. Any ship can therefore respond, by means of control 82, to this 'broadcast' transmission by 'returning' a coded signal 83 over the control link 80 if a communications circuit is required, as shown in FIG. 8. As shown by way of example (FIG. 9) the transmitter transmits each iteration loop 1–4 of 100 steps (90–93) in a 1 sec time period with the time Tp=10 ms allocated to each iteration step. Between iteration loops the transmitter is quiet for a period Td awaiting a coded signal 94 corresponding to the iteration step number N (0<N<101) giving the maximum received signal at the ship. The signal 94 codifies (95) the appropriate step number (2 as shown here). The coded signal 94 is transmitted from the ship to shore via the feedback control link 80. The step number is then decoded 210 and provides the selected phase for the start of the second loop of the phase algorithm (91). The shore transmitter beamformer will then be able to create a beam of modest gain (between 16 and 22 dB) directed at the ship and can then go on to improve the beam gain by using the 2nd, 3rd and 4th iteration loop sequences (91–93). The choice of 100 iteration steps per sec depends upon the bandwidth of the system. With a wider bandwidth a faster rate can be selected and visa versa.

After the 4th iteration loop the ERP gain of the transmitter beam will always be greater than 21 dB. The predicted response 84 calculated by computer based on the array model 85 can then be used to determine the direction of the ship.

The ship's system (FIG. 8) (in this example) includes switches 86, 27 between the control and the receiver (Rx) and transmitter (Tx) for respectively connecting received user data 87 for storage/display and ships user data 88 for transmission to shore for storage/display (89). The delay Tr between shore transmission 90–93 and ship's response 94 can be made pseudo-random to improve security and anti-jamming (AJ) capability of the system. The timing of the iteration steps of the first broadcast transmission 90 can be pseudo-randomly chosen or can be periodic but the average delay between each emission must be adequate to meet the link demands.

For point to point circuits (i.e. ship to ship) the transmitter power to each antenna can be significantly reduced during beamforming (and during subsequent transmissions) because the initial beam gain is so high (>16 dB). For example, if the power to each antenna is only 10 W the ERP after the first iteration will be >400 W and after the 4th iteration it will on average be 1800 W.

Figure 10:
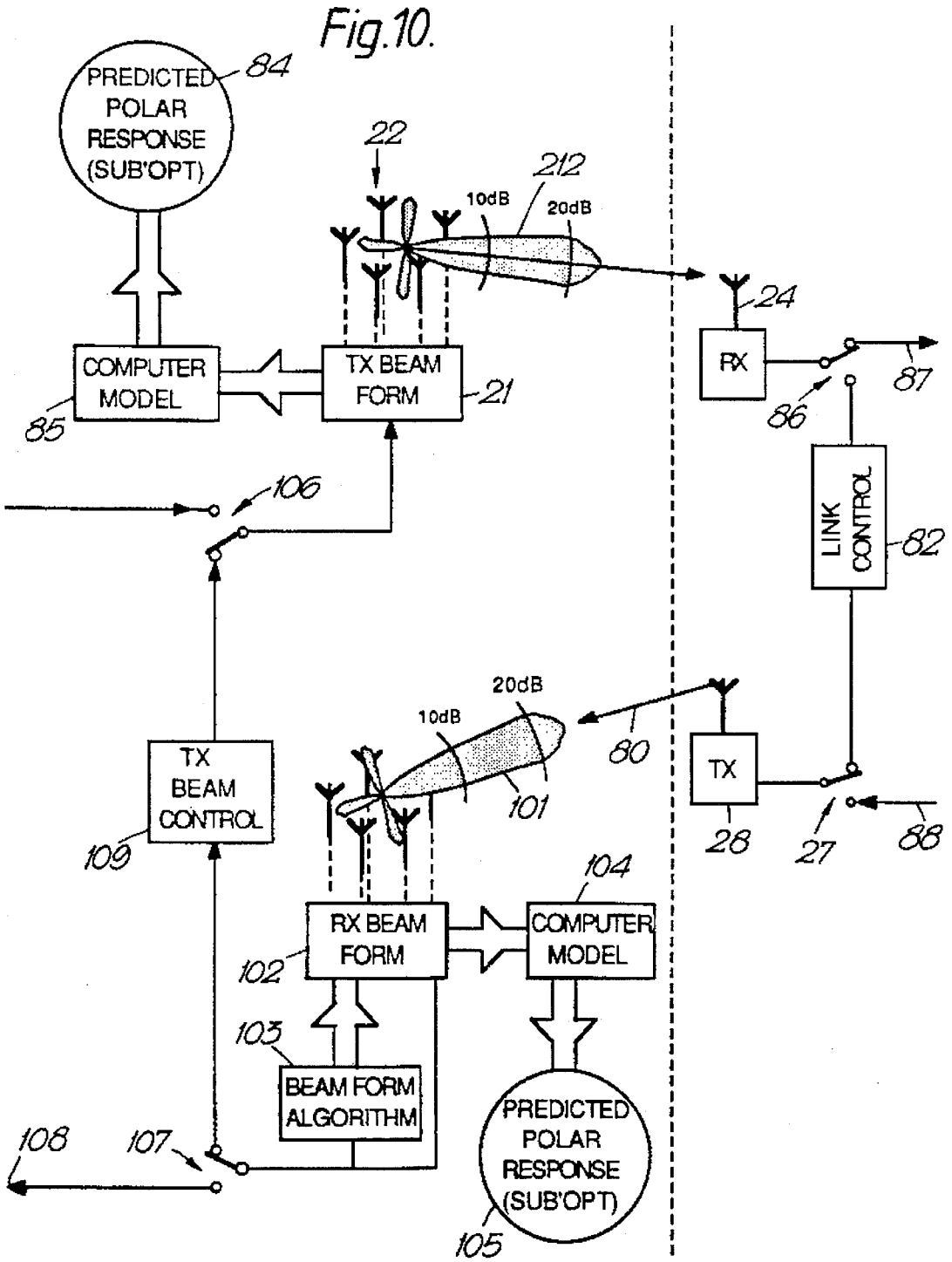
FIG. 10 shows a block diagram of a combined adaptive transmit and receive system.

A further improvement in communications can be obtained if both transmitting and receiving beam-forming are used. FIG. 10 shows how this can be done for a shore system, but the concept will equally apply to ship receive and transmit channels.

The transmitting beam 212 in FIG. 10 is produced in exactly the same way as described for FIG. 8 (and in FIG. 9) but the receive beamforming is generated by a separate adaptive algorithm (i.e. decision tree or random phase) using the ship transmissions, as previously described.

In the FIG. 10 arrangement integers previously described with reference to FIGS. 2 and 8 are given like reference numerals. The receive beam 101 is produced by the receive beamformer 102 under control of a second beam forming algorithm (103). The optimal beam, once formed, is compared with a computer array model 104 to produce a predicted receive beam polar response (105). Switches 106 and 107 determine the connection of transmit data to the transmit beamformer 21, the connection of receive data from the receive beamformer 102 to a display or store input 108 and the connection of feedback control signals from the ship's transmitter 28 to the transmitter beamforming algorithm, shown in a beam control 109. For the sake of clarity coding and decoding of signals is not shown. The advantage of using simultaneous shore transmit and receive beamforming is to improve LPI communications to the ship because much lower transmitter powers can be used, and the narrow Tx and Rx antenna beams can reduce the threat of interception or jamming. Additionally, the estimated position of the vessel can be determined from the two predicted polar radiation plots produced by the transmit and receive beamforming systems.

Normally it will be more advantageous to employ beamforming at both ends of the communication link since this will increase the ERP of transmission and improve the received signal to noise ratio at the receiver.

The beams formed by antenna arrays according to the invention should offer significant improvements in communication performance because they will maximise the RF power efficiency on transmission and increase the signal to noise ratio of signals on reception.

On transmission, the signal power can now be significantly greater than the power of the radio transmitter because the beam gains produced by the array will increase the Effective Radiated Power (ERP). Furthermore, the direction of this signal power can be precisely controlled, as a 'narrow' energy beam, and be transmitted in the exact direction (and elevation) of the receiver. The efficiency of transmission will therefore be significantly greater than existing systems in which the signal power is (normally) transmitted omni-directionally, but in practice, for example, radiation nulls of up to 30 dB can sometimes occur, particularly on ships.

This improvement in radiation efficiency is not only beneficial because it improves the received signal to noise (by transmitting more signal power) but because it can use less transmitter power to achieve it. This can reduce co-site interference and also improve LPI, particularly when coupled with Automatic Radiation Power Control. Interception will also be more difficult because most of the signal power is transmitted in one specific direction, as a narrow beam, with very little power transmitted elsewhere.

On reception, an adaptive receiving array will enhance the wanted signal level and simultaneously reduce the total received interference (or jamming) level. This will improve the received signal to noise quality by (on average) about half the beam gain. This improvement can be increased still further if it is used in conjunction with transmit beamforming. This additional improvement will be proportional to the effective increase in transmitter power.

Receive beamforming can also improve LPI because the transmitting power can now be reduced by about half the receive beam again, i.e. the same as the improvement in received signal to noise ratio. An Automatic Radiated Power Control facility should therefore become an integral part of the beamforming system because it can improve LPI and reduce co-site interference. Alternatively, if used as a jamming countermeasure, this system is able to offer an increased AJ margin because the transmitted signal ERP can be significantly greater than the available Tx power and the received signal to jammer ratio will be improved because the receive beam will attenuate the jammer power level.

Typically the power gain for a 16 element transmitting array will be about 23 dB or a 200:1 increase in power, relative to one antenna. The power to each antenna might only be 100 W but the transmitter signal will be 20 kW. In a jamming environment the transmit system will therefore yield an AJ gain of about 11 dB (since the total transmitter power available is 1.6 kW). Receive beamforming can increase this margin by a further 23 dB but this will depend on the direction of the jammer and the polar radiation pattern of the array.

In a normal, non-jamming, environment a communication circuit may, for example, only need 50 W of transmitter power so the power to each antenna can be reduced to 250 mW. The total RF transmitter power therefore need is now only 4 W, or less than −10 dB. The overall reduction in co-site intermodulation products will therefore be >30 dB (for 3rd order or higher products) and intercept will be much more difficult than before.

Conventional beamformers use sophisticated algorithms, for example, by use of a least means squares iterative approach. Once such conventional algorithms have a bad start point—they cannot recover. With the random phase approach of the current invention there is a high probability of forming a relatively high gain beam in the correct direction. Thus the system will work under bad conditions. The system also requires no a priori knowledge of the arrays or of the required direction. Thus the system should be relatively simple and cheap.

The polar radiation field produced by a beamforming adaptive array will vary with frequency and/or the size of the antenna array. Generally, the lower the frequency or the smaller the array, then the broader the radiated beam will become and the 'smoother' the overall response.

Variation in the radiated pattern shape and beamwidth can therefore be achieved if the size of the antenna array can be altered to suit the operational frequency. On shore this is not a problem because a large number of antennas can be used (with only some of the antennas being used at any one time) and the correct grouping and overall size of the antenna array can be altered to suit the operational needs. Unfortunately, ship-board antenna systems will never have the same degree of flexibility as those on shore because of the limited area available but it can be shown that a modest increase in antenna array size can provide adequate (narrow beam) forming performance above 6 MHz. At lower frequencies beamwidth may not be so critical anyway because the system could be used exclusively for groundwave communications (ie local broadcast/net). For example, at just below 4 MHz the radiated pattern is very broad, although still directional, and at even lower frequencies the signal becomes a high gain omnidirectional groundwave signal, with a low elevation angle (less than 30°).

It can be shown that, provided the antenna elements are sensibly dispersed, the polar radiation patterns are generally insensitive to array variations and a good beam performance can generally be obtained irrespective of array antenna disposition. However, for the smaller ship array it has been shown that a better (narrow) beam performance can be obtained if the antennas are more evenly placed in the deck area available.

A very important characteristic of beamforming antenna arrays will be the frequency bandwidth of the ERP in the wanted direction. Having formed a beam on a given carrier frequency and direction, the phase co-efficients derived by the control algorithm for each array element will normally become fixed (provided the array is stationary and the wanted direction remains the same). If the frequency of this signal is changed (ie offset from the original carrier) the beam gain will be reduced because the antenna geometry and phase coefficients are only exactly correct for the original frequency. This fall in ERP gain will be in proportion to the change in frequency and also to the antenna array size (relative to the carrier frequency). It has been shown that a change in working frequency of ±10 percent variation at 3.8 MHz produces a negligible change in the radiation pattern gain whereas at 15 MHz there may only be a little change in the shape of the pattern but there is a drop of nearly 3 dB in the ERP gain of the beam. This is a very important characteristic because if very narrow beams are used then the working bandwidth will be considerably reduced. For conventional communications (3 KHz BW) this affect will be negligible and very large array sizes, producing very narrow beams, are fully acceptable. But for wideband or frequency hopping waveforms (2 to 3 MHz BW) this effect will be critical so the array size (relative to operational frequency) will have to be limited and so therefore, will the narrowness of the beamwidth.

The beamforming algorithm according to the present invention will (automatically) always produce a beam of maximum gain on the desired signal coming from any direction. The selection of the desired signal is decided by a special signal discriminator. Having automatically formed the beam, the computer model (with errors) of the antenna array can be used, as described earlier, with the phase array output from the control algorithm to produce a predicted polar (sub-optimal) response. This predicted response will not be the same as the array response because the phasing signals produced by the control algorithm will have taken into account any 'errors' between the calculated antenna positions and the actual positions (ie <=±90° or λ/4). The predicted response has been shown to be marginally different to the actual polar radiation pattern. In operation this will have little effect on the performance of the system because an operator can still easily identify the (true) beam direction.

The advantages of this direction finding system are that an optimal beam will always be automatically formed on the desired signal and the operator can determine the direction and elevation of the beam using the predicted beam response. The disadvantages of a normal calibrated system are that it can only start to create the ideal beam on the wanted signal if it can already receive it before having formed the beam. However, this problem has been resolved by randomly varying the phase controls until a good wanted signal is detected. However, the signal discriminant must be as good as possible because any stronger unwanted signals may 'capture' the system and move the beam away from the desired signal direction. The disadvantages of this particular system can be overcome if Calibrated and Adaptive Array principles are combined. The system could first work as a Calibrated Array to produce a beam on the weak wanted signal and then a limited phase (±90°) adaptive algorithm could then be used to create an ideal beam at maximum gain. This system would resist jamming by other signals and could operate with very weak signals but it would not be fully automatic since it requires the operator to initally "steer" the beam to the correct direction and elevation. This particular arrangement is especially advantageous when using the system for signal interception because the listener may know the direction of the signal source but may be unaware of the signal waveform (and therefore the appropriate signal discriminant).

I claim:

1. A communications equipment including an adaptive transmitter beamforming equipment for connection to an array of antennas in a high frequency communications system comprising:

a) a high frequency transmitter having an input for receiving a test signal to be transmitted and an output arrangement for providing a plurality of identical signals for transmission;

b) means to independently adjust the phase of each output signal;

c) means for connecting the phase-adjusted signals to respective antennas in the array;

d) means to initialise the phases to zero;

e) means to randomly set the phase of each output signal within predetermined limits of the initialised phases;

f) means to repeat step d) a number (N) of times;

g) remote receiver means to determine which one of the random phase sets (N) produces the maximum received signal and to produce a coded signal representative of that one number;

h) means to transmit the coded signal to the high frequency transmitter;

i) means to decode the number signal and to initialise the phases to the phase set producing the maximum signal at the remote receiver;

j) means to set a lower predetermined limit for the phase adjustments; and k) means to repeat steps e) to j) to successively improve the focus of the transmitter beam towards the receiver.

2. An adaptive beamforming equipment as claimed in claim 1 wherein the array for transmission is formed from a plurality of wideband dipoles or monopoles.

3. An adaptive beamforming equipment as claimed in claim 2 wherein the number of steps (N) in each iteration phase is 100.

4. An adaptive beamforming equipment as claimed in claim 3 wherein the limits for the phase adjustments in the iteration phases are successively set at ±180°; ±90°; ±60° and ±40°.

5. An adaptive beamforming equipment for communications transmission as claimed in claim 4 wherein the remote receiver includes: a signal discriminator selectively responsive to the transmitter test signals and the remote receiver transmits the coded number signal, representing the transmitter step producing the maximum received signal, a discrete time after receiving the first stage of N test transmissions.

6. An adaptive beamforming equipment as claimed in claim 5 wherein the discrete time for the coded response is pseudo-randomly selected after each stage.

7. A communications system including an adaptive antenna array for both transmission and reception as claimed in claim 6.

8. A communications system as claimed in claim 7 wherein a transmitter/receiver is provided with adaptive beamforming for both reception and transmission, the arrangement being such that separate beamforming algorithms are provided for transmission and reception.

9. A communications system as claimed in claim 8 wherein a random phase beamformer is used for one mode, transmission or reception, and a decision tree beamformer is used for the second mode.

10. A communications system as claimed in claim 9, the arrangement being such that once the transmission or reception beam is formed there is provided means to generate a predicted polar beam response from stored data on the array, the predicted polar response serving to provide a direction finding capability.

11. A communications system as claimed in claim 10 polar responses are produced from both the transmission beamformer and the reception beamformer.

12. A communications system transmitter including adaptive beamforming as claimed in claim 11 wherein there is provided means to automatically limit the transmitted power radiated in the direction of the beam so as to minimise possible co-site interference and the likelihood of unwanted interception.

13. A communications system as claimed in claim 12 wherein there is included a combined calibrated array and adaptive phase algorithm such that where information on the direction of the receiver or the transmitter is known the communications equipment is provided with beamforming means to produce a first calibrated array in the desired or known direction and then to apply limited random phase iterations to optimise the beam direction.

14. An adaptive receiver beamforming equipment for connection to an array of antennas in a high frequency communications system comprising:

a) a high frequency receiver having a plurality of inputs for receiving signals produced by respective antennas in the array in response to a remote transmission;

b) means to independently adjust the phase of each antenna signal;

c) means for connecting the phase-adjusted signals to the receiver;

d) means to initialise the phases to zero;

e) means to randomly set the phase of each output signal within predetermined limits of the initialised phases;

f) means to repeat step d) a number (N) of times;

g) means to determine which one of the random phase sets (N) produces the maximum received signal;

h) means to initialise the phases to the phase set producing the maximum received signal;

i) means to set a lower predetermined limit for the phase adjustments; and j) means to repeat steps e) to i) to successively focus the receiver beam towards the transmitter.

15. An adaptive beamforming equipment as claimed in claim 14 wherein the array for reception is formed from a plurality of wideband dipoles or monopoles.

16. An adaptive beamforming equipment as claimed in claim 15 wherein the number of steps (N) in each iteration phase is 100.

17. An adaptive beamforming equipment as claimed in claim 16 wherein the limits for the phase adjustments in the iteration phases are successively set at ±180°; ±90°; ±60° and ±40°.

18. A communications system including an adaptive antenna array for both transmission and reception as claimed in claim 17.

19. A communications system as claimed in claim 18 wherein a transmitter/receiver is provided with adaptive beamforming for both reception and transmission, the arrangement being such that separate beamforming algorithms are provided for transmission and reception.

20. A communications system as claimed in claim 19 wherein a random phase beamformer is used for one mode, transmission or reception, and a decision tree beamformer is used for the second mode.

21. A communications system as claimed in claim 20, the arrangement being such that once the transmission or reception beam is formed there is provided means to generate a predicted polar beam response from stored data on the array, the predicted polar response serving to provide a direction finding capability.

22. A communications system as claimed in claim 21 polar responses are produced from both the transmission beamformer and the reception beamformer.

23. A communications system transmitter including adaptive beamforming as claimed in claim 22 wherein there is provided means to automatically limit the transmitted power radiated in the direction of the beam so as to minimise possible co-site interference and the likelihood of unwanted interception.

24. A communications system as claimed in claim 23 wherein there is included a combined calibrated array and adaptive phase algorithm such that where information on the direction of the receiver or the transmitter is known the communications equipment is provided with beamforming means to produce a first calibrated array in the desired or known direction and then to apply limited random phase iterations to optimise the beam direction.

* * * * *